US010087654B2

(12) United States Patent
Nguyen et al.

(10) Patent No.: US 10,087,654 B2
(45) Date of Patent: Oct. 2, 2018

(54) CYLINDER LOCK

(71) Applicant: ASSA ABLOY Access and Egress Hardware Group, Inc., Berlin, CT (US)

(72) Inventors: David T. Nguyen, Farmington, CT (US); Damon J. Lenk, Bristol, CT (US)

(73) Assignee: ASSA ABLOY Access and Egress Hardware Group, Inc., Berlin, CT (US)

( * ) Notice: Subject to any disclaimer, the term of this patent is extended or adjusted under 35 U.S.C. 154(b) by 0 days.

(21) Appl. No.: 13/962,597

(22) Filed: Aug. 8, 2013

(65) Prior Publication Data

US 2013/0319058 A1 Dec. 5, 2013

Related U.S. Application Data

(63) Continuation of application No. 13/452,438, filed on Apr. 20, 2012, now Pat. No. 8,635,022.

(51) Int. Cl.
*E05B 27/06* (2006.01)
*E05B 27/08* (2006.01)
(Continued)

(52) U.S. Cl.
CPC ..... *E05B 27/08* (2013.01); *E05B 27/0039* (2013.01); *E05B 27/0042* (2013.01);
(Continued)

(58) Field of Classification Search
CPC .. E05B 27/00; E05B 27/0003; E05B 27/0007; E05B 27/0017; E05B 27/0021;
(Continued)

(56) References Cited

U.S. PATENT DOCUMENTS 1,594,033 A * 7/1926 Anakin ..... 70/493
2,232,137 A * 2/1941 Rolph ..... E05B 27/005 70/378
(Continued)

FOREIGN PATENT DOCUMENTS

CN 1181121 A 5/1998
DE 19939734 A1 5/2001
(Continued)

OTHER PUBLICATIONS

Security Snobs.com, Choosing a Brand, accessed May 10, 2010, https://securitysnobs.com/Choosing-A-Brand.html.
(Continued)

*Primary Examiner* — Lloyd A Gall
(74) *Attorney, Agent, or Firm* — Dennis J. Williamson; Moore & Van Allen, PLLC

(57) ABSTRACT

A locking mechanism is provided for a lock body and a rotatable key plug. The locking mechanism comprises pins having recesses, each of the pins adapted to be disposed in pin bores in the key plug for reciprocal and rotational movement. An elongated spring member simultaneously engages and biases the pins toward a keyway in the key plug. A locking bar moves between a first position and a second position where at least a portion of the locking bar is received in the recesses in the pins. The locking bar is prevented from moving to the second position unless the pins are in a position where the recesses are aligned with the locking bar. Upon insertion of a key in the keyway the pins are moved axially or rotated for aligning the recesses in the pins with the locking bar so the key can rotate the key plug.

15 Claims, 12 Drawing Sheets

(51) Int. Cl.
*E05B 27/00* (2006.01)
*E05B 15/04* (2006.01)

(52) U.S. Cl.
CPC .. *E05B 27/0082* (2013.01); *E05B 2015/0458* (2013.01); *Y10T 70/7565* (2015.04); *Y10T 70/761* (2015.04); *Y10T 70/7605* (2015.04); *Y10T 70/7616* (2015.04)

(58) Field of Classification Search
CPC ..... E05B 27/0035; E05B 27/0039; E05B 27/0057; E05B 27/0082; E05B 27/02; E05B 27/0053; E05B 27/001; E05B 27/0078; E05B 27/08; E05B 27/0042; E05B 2015/0458; Y10T 70/761; Y10T 70/7616; Y10T 70/7565; Y10T 70/7605
USPC .... 70/493–496, 358, 421, DIG. 54, DIG. 55, 70/DIG. 74, 372, 378, 391, 392
See application file for complete search history.

(56) References Cited

U.S. PATENT DOCUMENTS

| | | | | | |
|---|---|---|---|---|---|
| 2,460,551 | A * | 2/1949 | Swanson | 70/495 | |
| 2,739,473 | A * | 3/1956 | Quillen | 70/383 | |
| 2,879,659 | A * | 3/1959 | Jacobi | E05B 27/00 | 70/493 |
| 2,949,762 | A * | 8/1960 | Johnstone | 70/495 | |
| 3,507,133 | A * | 4/1970 | Basseches | 70/421 | |
| 3,722,240 | A * | 3/1973 | Spain et al. | 70/494 | |
| 3,739,611 | A * | 6/1973 | Ignatjev | E05B 29/00 | 70/276 |
| 3,974,670 | A * | 8/1976 | Wolter | 70/493 | |
| 4,069,693 | A * | 1/1978 | Spalding | E05B 29/00 | 70/377 |
| 4,103,526 | A * | 8/1978 | Surko, Jr. | 70/494 | |
| 4,723,427 | A * | 2/1988 | Oliver | 70/494 | |
| 4,998,426 | A * | 3/1991 | Genakis | 70/494 | |
| 5,475,998 | A | 12/1995 | Raskevicius et al. | | |
| 5,617,750 | A * | 4/1997 | Preddey | 70/419 | |
| 5,682,779 | A * | 11/1997 | Dolev | 70/494 | |
| 6,257,033 | B1 * | 7/2001 | Ziv-Av | 70/494 | |
| 6,526,791 | B2 * | 3/2003 | Shvarts | 70/419 | |
| 7,308,811 | B2 * | 12/2007 | Armstrong et al. | 70/492 | |
| 7,337,639 | B2 * | 3/2008 | Edwards, Jr. | 70/409 | |
| 7,377,146 | B2 * | 5/2008 | Field et al. | 70/495 | |
| 7,574,883 | B2 * | 8/2009 | Grampurohit | 70/493 | |
| 7,810,364 | B2 * | 10/2010 | Widen | 70/409 | |
| 8,327,675 | B2 * | 12/2012 | Baumann | 70/494 | |
| 8,635,022 | B2 * | 1/2014 | Nguyen et al. | 701/493 | |
| 2004/0000178 | A1 * | 1/2004 | Tseng | 70/358 | |
| 2005/0061043 | A1 | 3/2005 | Widen | | |
| 2005/0072199 | A1 * | 4/2005 | Edwards, Jr. | 70/493 | |
| 2005/0268678 | A1 * | 12/2005 | Price | 70/358 | |
| 2006/0027006 | A1 * | 2/2006 | Di Vito | 70/493 | |
| 2006/0207304 | A1 * | 9/2006 | Widen | 70/494 | |
| 2008/0223097 | A1 * | 9/2008 | Field et al. | 70/494 | |
| 2010/0037666 | A1 * | 2/2010 | Chong | 70/490 | |

FOREIGN PATENT DOCUMENTS

| | | | |
|---|---|---|---|
| DE | 102005036113 | A1 | 3/2006 |
| DE | 102009026117 | A1 | 1/2011 |
| EP | 0557606 | A1 | 9/1993 |
| EP | 0567832 | A1 | 11/1993 |
| EP | 2423412 | A2 | 2/2012 |
| FR | 1458605 | | 3/1966 |
| FR | 1574767 | | 7/1969 |
| FR | 2833031 | A3 | 6/2003 |
| GB | 2358670 | A | 8/2001 |
| SE | 432277 | * | 3/1984 |
| WO | 2006098675 | A1 | 9/2006 |

OTHER PUBLICATIONS

Opening Locks by Bumping in Five Seconds or Less: Is It Really a Threat to Physical Security?, 2006, http://www.security.org.
Double-sided Key Dimensions, Dimensions Guide, accessed May 10, 2010, http://www.dimensionsguide.com/double-sided-key-dimensions.
Corbin Russwin, Inc., International Application No. PCT/US2013/037388, International Search Report and Written Opinion, dated Aug. 21, 2013.
Corbin Russwin, Inc., Chinese Patent Application No. 201380032498.3, First Office Action, dated Mar. 3, 2016.
Corbin Russwin, Inc., Canadian Patent Application No. 2,870,450, Office Action, dated Aug. 16, 2016.
Corbin Russwin, Inc., Chinese Patent Application No. 201380032498.3, Second Office Action, dated Nov. 30, 2016.

* cited by examiner

CYLINDER LOCK

CROSS REFERENCES

This application is a continuation application of U.S. patent application Ser. No. 13/452,438, filed Apr. 20, 2012, the contents of which are incorporated herein by reference.

BACKGROUND

A cylinder lock is described and, more particularly, a cylinder lock comprising two or more independent locking mechanisms, including conventional tumblers and twisting tumblers and an associated locking bar. Also described is a key for operating the locking mechanisms when placed in a keyway of the cylinder lock.

Cylinder locks for locking doors, cabinets and other structures are well known in the art. Conventional cylinder locks typically include a cylinder shell, and a cylinder plug rotatably disposed within the shell. The interface between the interior surface of the cylinder shell and the exterior surface of the cylinder plug forms a shear surface. A plurality of tumbler pins are reciprocally mounted in chambers extending through the shell and the plug. The tumbler pins are a series of spring-driven segmented pins, including an upper portion and a lower portion. The cylinder lock is in a locked condition when the upper portions of the tumbler pins project across the shear surface preventing the cylinder plug from rotating relative to the cylinder shell.

The cylinder plug has a longitudinal slot or keyway for receiving a key blade of a key. Notches of varying depth along the top of the key blade define a key code for the cylinder lock. A properly configured key blade displaces the tumbler pins to a position where a joint between the upper portion and the lower portion of each pin is aligned with the shear surface. In this position, the cylinder lock is in an unlocked condition, which permits rotation of the cylinder plug relative to the cylinder shell. One portion of each tumbler pin rotates with the plug and the remaining portions of the tumbler pins are stationary within the shell. The cylinder plug is typically coupled with a lock actuator that rotates with the plug for releasing a securing mechanism, such as a dead bolt, upon rotation of the plug.

A second independent locking mechanism can also be provided in the form of a second set of tumbler pins. The second set of tumbler pins may be operated by a corresponding lock code cut in the form of notches of varying depth or angle along the sides of the key blade. The second set of tumbler pins can control a secondary locking structure, including a locking bar positioned in the cylinder plug. The locking bar rests in a camming slot of the cylinder shell preventing relative rotation of the cylinder plug and cylinder shell. When the second set of tumblers are received in corresponding notches of the key blade, the tumblers are displaced transversely permitting rotation of the cylinder plug by a camming action on the locking bar.

A problem with cylinder locks is the spring-driven tumbler pins, which typically comprise small coil springs. As a result, cylinder locks are not fully reliable since the springs may become weaker over time or be damaged as a result of environmental variations.

For the foregoing reasons, there is a need for a cylinder lock with two or more locking mechanisms and a complementary key. The new cylinder lock should provide an improved biasing element that overcomes the problems associated with the use of coil springs.

SUMMARY

A lock assembly is provided comprising a lock body including an inner surface defining a bore having a longitudinal axis and a longitudinal slot extending along at least a portion of the inner surface. The lock body defines a plurality of longitudinally spaced pin bores extending substantially perpendicular to the longitudinal axis from an outer surface of the lock body and opening into the bore. A key plug is also provided and defines a longitudinal keyway extending from one end and having an outer surface defining a longitudinal groove. The key plug further defines a first plurality of longitudinally spaced pin bores extending substantially perpendicular to the longitudinal axis of the key plug from the outer surface of the key plug and opening into the keyway, and a second plurality of longitudinally spaced pin bores extending substantially perpendicular to the longitudinal axis of the key plug from the outer surface of the key plug and opening into the keyway. The longitudinal groove in the outer surface of the key plug opens into the second plurality of pin bores. The key plug is rotatably disposed in the bore of the lock body such that in a first position the pin bores in the lock body align with the first plurality of pin bores in the key plug, and wherein the outer surface of the key plug defines a shear plane with the inner surface of the lock body. A first plurality of pins includes a first outer portion and a second inner portion, each of the first portion and the second portion of the pins disposed in one of the pin bores in the lock body and in one of the first plurality of pin bores in the key plug. Means are provided for urging the first plurality of pins toward the keyway such that the first outer portions of the pins span the shear plane to prevent rotation of the key plug relative to the lock body when a key is not in the keyway. A second plurality of pins is provided and having a recess formed therein. Each of the second plurality of pins is disposed in one of the second plurality of pin bores in the key plug for reciprocal or rotational movement about an axis. An elongated spring member simultaneously engages and biases the second plurality of pins toward the keyway. The spring member is disposed in a longitudinal slot defined in the outer surface of the key plug contiguous with the second plurality of pin bores. A locking bar is disposed in the groove in the key plug for movement between a first position where the locking bar is received in the slot in the lock body and a second position where at least a portion of the locking bar is received in the recesses in the second plurality of pins. The locking bar is prevented from moving to the second position unless the second plurality of pins are in a predetermined position where the recesses are aligned for receiving the at least a portion of the locking bar. Means are provided for biasing the locking bar to the first position. Upon insertion of a proper key in the keyway the first plurality of pins are moved axially in the bores in the lock body and the key plug such that the junction between the first portion and the second portion of the first plurality of pins aligns with the shear plane, and the second plurality of pins are moved axially or rotated about their axes for aligning the recesses in the second plurality of pins with the locking bar. Thus, the key can rotate the key plug and the locking bar cams against the slot in the lock body to move the locking bar into the second position where the projections on the locking bar are in the recesses to allow rotation of the key plug.

A locking mechanism is provided for use in a lock assembly including a lock body having an inner surface defining a bore having a longitudinal axis and a longitudinal slot extending along at least a portion of the inner surface. A key plug defines a keyway extending longitudinally from one end and a plurality of longitudinally spaced pin bores extending from the outer surface of the key plug and opening into the keyway. The key plug is rotatably disposed in the bore of the lock body. The locking mechanism comprises a plurality of pins having a recess formed therein, each of the plurality of pins is adapted to be disposed in one of the plurality of pin bores in the key plug for reciprocal and rotational movement about an axis. An elongated spring member simultaneously engages and biases the plurality of pins toward the keyway, the spring member adapted to be disposed in a longitudinal slot defined in the outer surface of the key plug contiguous with the plurality of pin bores. A locking bar is adapted to be disposed in the groove in the key plug for movement between a first position where the locking bar is adapted to be received in the slot in the lock body and a second position where at least a portion of the locking bar is received in the recesses in the plurality of pins. The locking bar is prevented from moving to the second position unless the plurality of pins are in a predetermined position where the recesses are aligned for receiving the at least a portion of the locking bar. Means are provided for biasing the locking bar to the first position. Upon insertion of a proper key in the keyway the plurality of pins are moved axially or rotated about their axes for aligning the recesses in the plurality of pins with the locking bar so the key can rotate the key plug and the locking bar cams against the slot in the lock body to move the projections on the locking bar into the recesses to allow rotation of the key plug.

BRIEF DESCRIPTION OF DRAWINGS

For a more complete understanding of the present invention, reference should now be had to the embodiments shown in the accompanying drawings and described below. In the drawings.

DESCRIPTION

Certain terminology is used herein for convenience only and is not to be taken as a limitation. For example, words such as "upper," "lower," "left," "right," "top", "bottom," "horizontal," "vertical," "upward," and "downward" merely describe the configuration shown in the FIGs. The terminology includes the words above specifically mentioned, derivatives thereof and words of similar import. Indeed, the components may be oriented in any direction and the terminology, therefore, should be understood as encompassing such variations unless specified otherwise.

The cylinder lock assembly described herein relates to an improvement for a standard cylinder lock. The cylinder lock assembly can also be used in an embodiment with an interchangeable core cylinder. The interchangeable core cylinder is designed with a second shear line and respectively requires a second key to turn the cylinder plug and a control sleeve simultaneously, thus retracting a portion of the control sleeve allowing easy installation and removal of the cylinder plug in a variety of cylinder housing designs for various applications. Since interchangeable core cylinders are described in the prior art, the details of operation will not be covered here.

Figure 1:
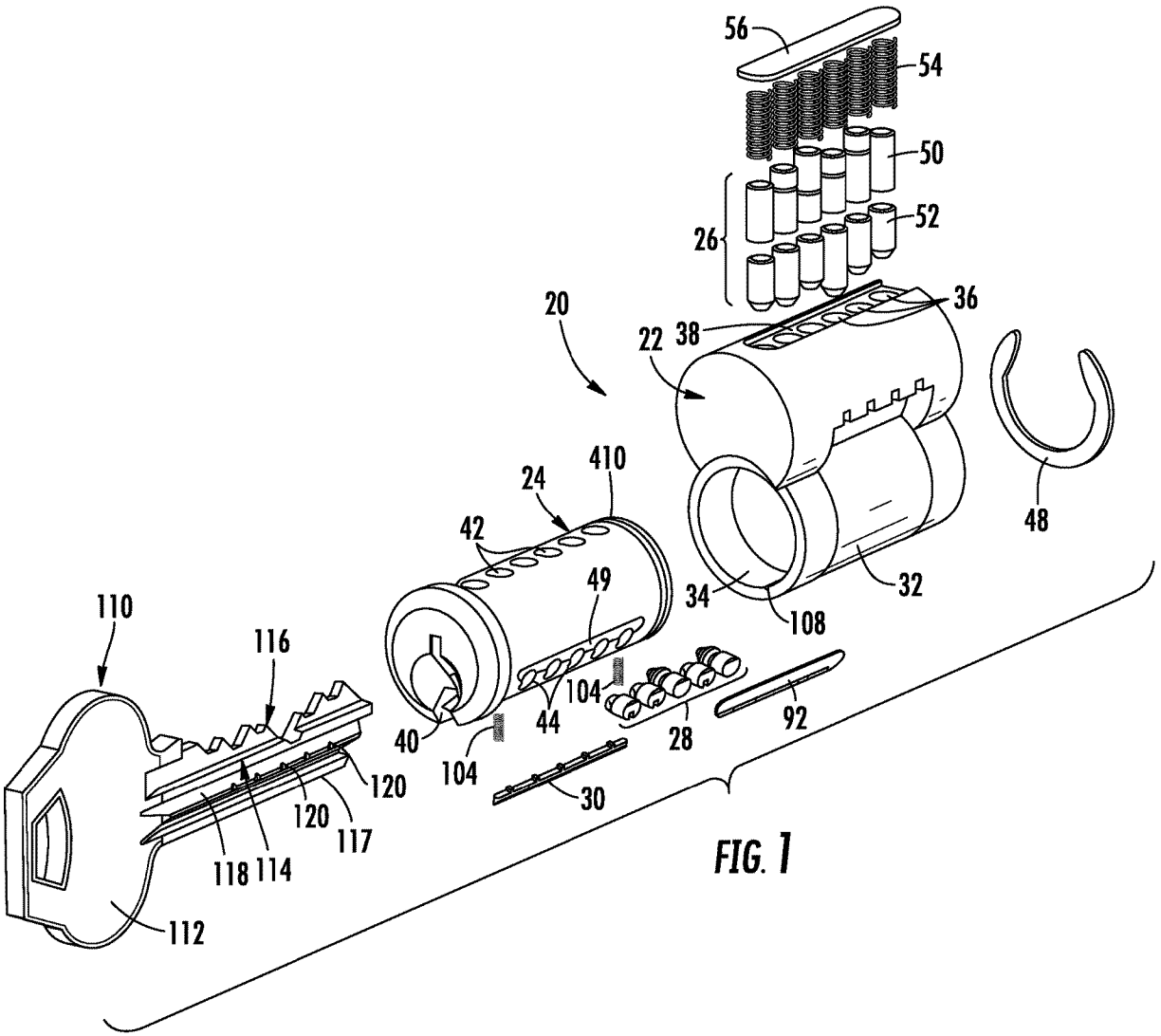
FIG. 1 is an exploded perspective view of an embodiment of a cylinder lock assembly with a second locking mechanism and a key.

Referring now to the drawings, wherein like reference numerals designate corresponding or similar elements throughout the several views, a cylinder lock assembly according to one embodiment is shown in FIG. 1 and generally designated at 20. The cylinder lock assembly 20 includes a cylinder lock body or cylinder shell 22 (also referred to as a stator) 22, a cylinder plug (also referred to as a rotor) 24, a first set of tumbler pins 26 and a second set of tumbler pins 28, and a locking bar 30. The cylinder lock body 22 is adapted to fit any type of door, cabinet, or other structure (not shown) for various applications. The cylinder lock body 22 includes a control sleeve 32 defining a bore 34 having a cylindrical inner surface for rotatably receiving the cylinder plug 24. The cylinder lock body 22 has a plurality of longitudinally-spaced radial chambers 36 for receiving the first set of tumbler pins 26. The tumbler-receiving chambers 36 extend transversely to the longitudinal axis of the cylinder lock body 22 from a longitudinal groove 38 in the top surface of the cylinder lock body 22 and open into the cylindrical bore 34 of the cylinder lock body 22.

Figure 2:
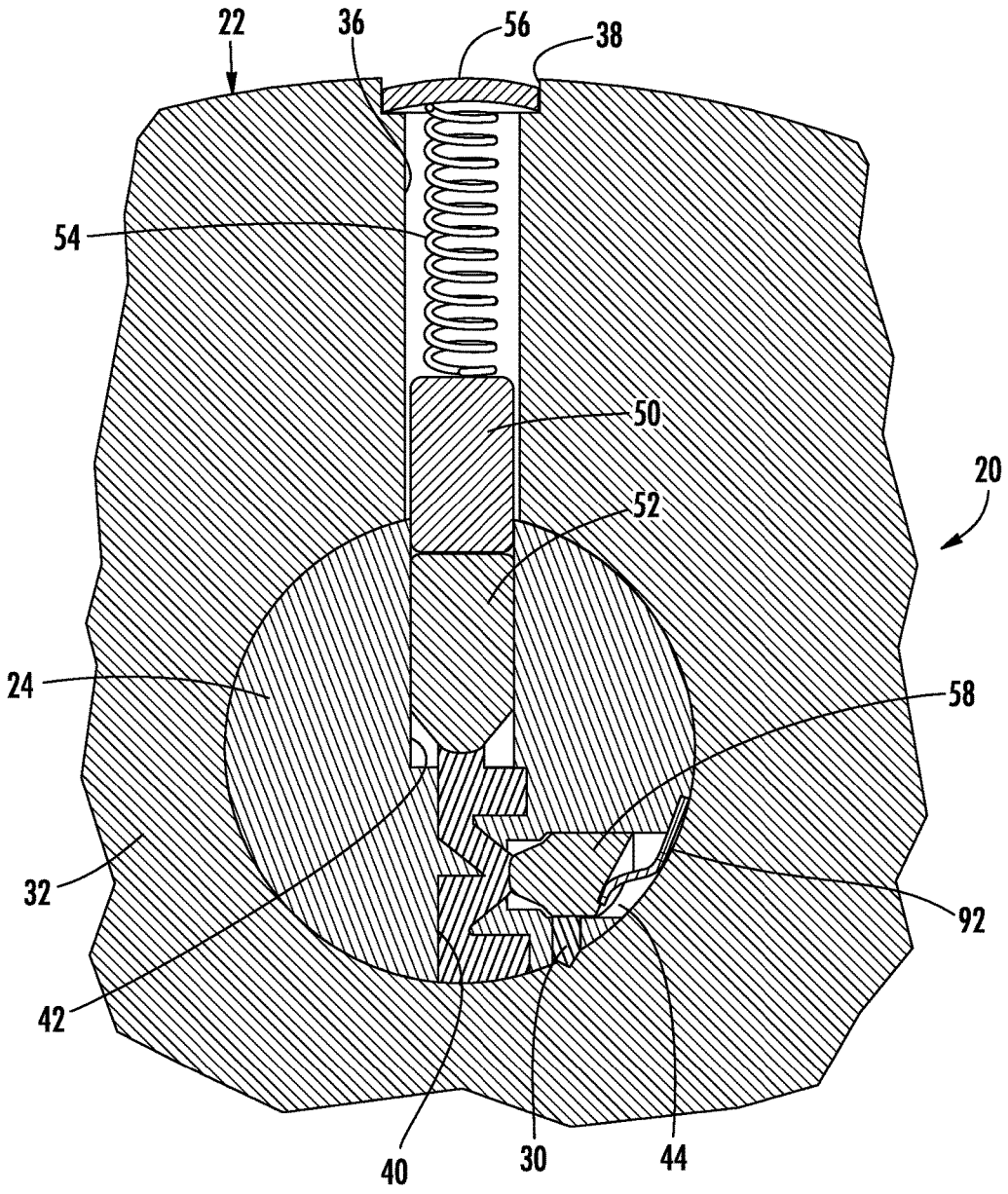
FIG. 2 is a transverse cross-section view of the cylinder lock shown in FIG. 1 being taken transversely at one set of tumbler pins and in a locked condition.
Figure 3:
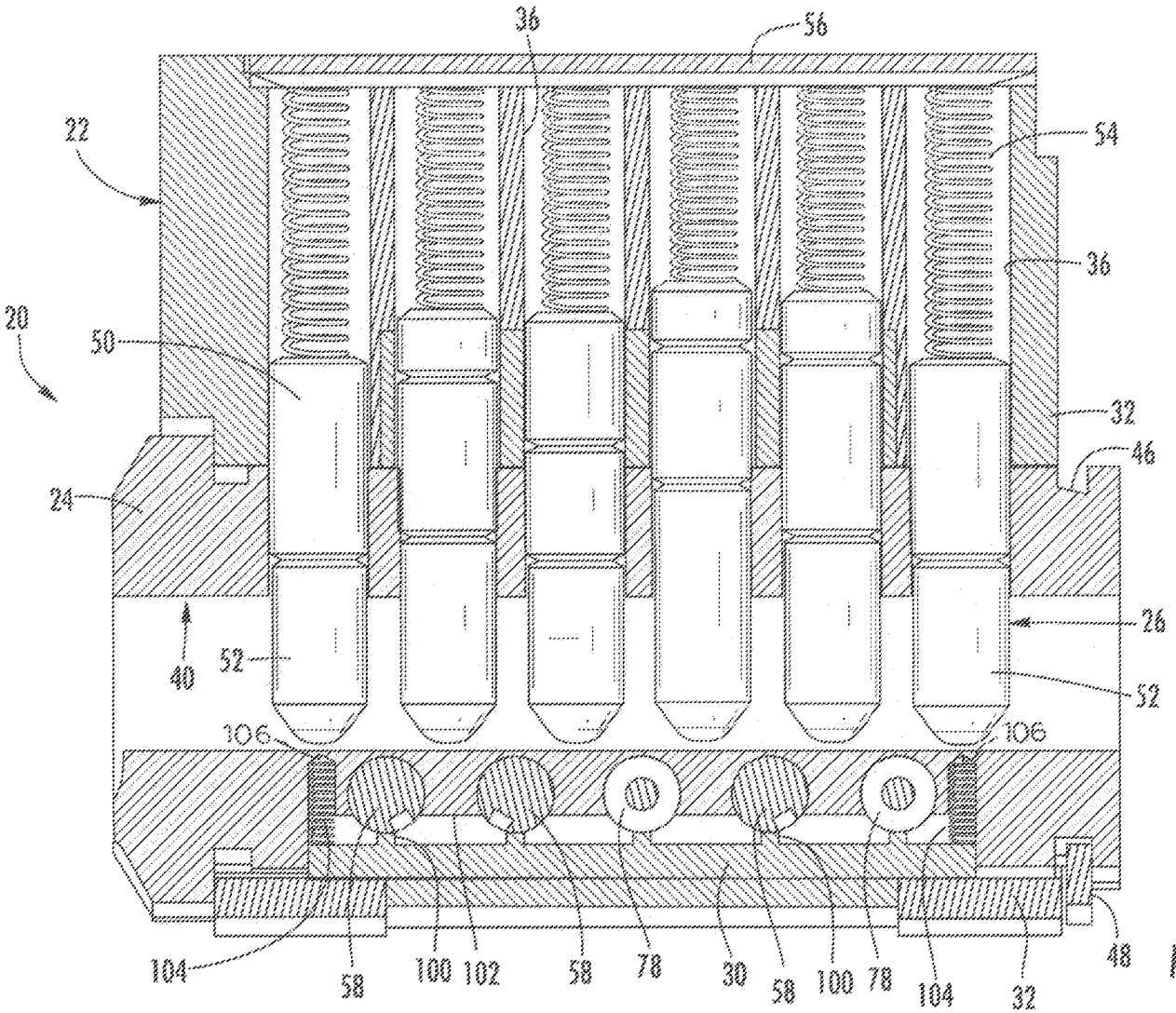
FIG. 3 is a longitudinal cross-section view of a portion of the cylinder lock assembly as shown in FIG. 1 in a locked condition taken through the locking bar and including the side pins.
Figure 4A:
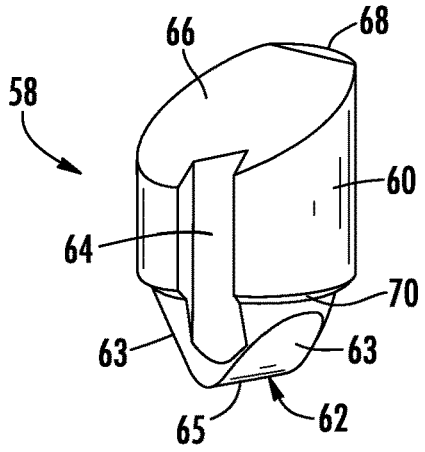
FIGS. 4A-4D are top and bottom plan views, a perspective view, and a side elevation view, respectively, of an embodiment of a chisel tip tumbler pin for use in a cylinder lock assembly as shown in FIG. 1.
Figure 4B:
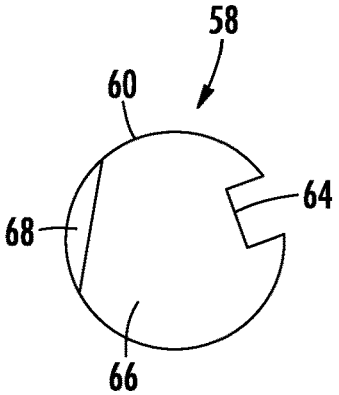
Figure 4C:
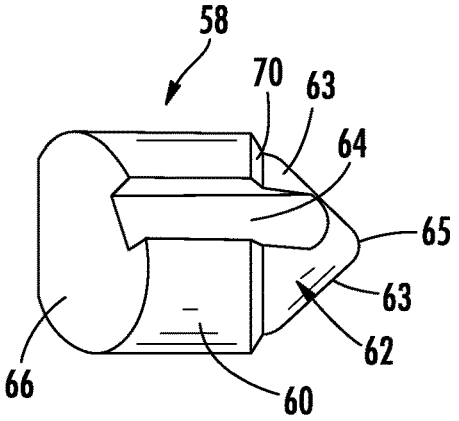
Figure 4D:
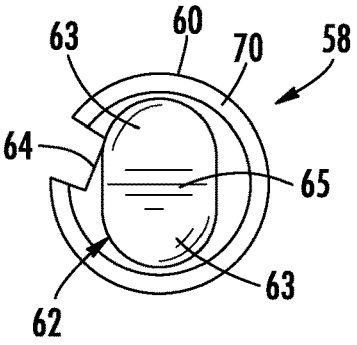
Figure 5A:
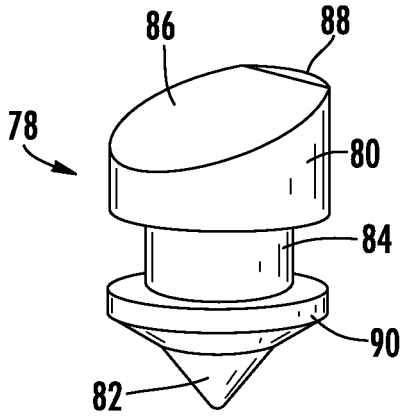
FIGS. 5A-5D are top and bottom plan views, a perspective view, and a side elevation view, respectively, of an embodiment of a conical tip tumbler pin for use in a cylinder lock assembly as shown in FIG. 1.
Figure 5B:
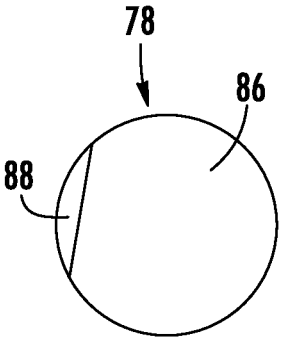
Figure 5C:
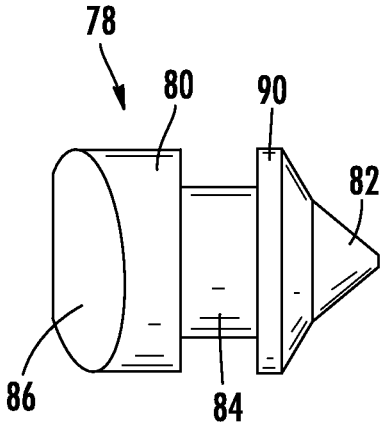
Figure 5D:
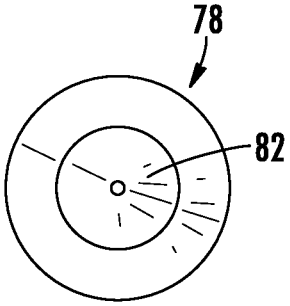

The cylinder plug 24 is cylindrical in shape and is received for rotation about its axis within the bore 34 of the cylinder lock body 22. The cylinder plug 24 defines an axial keyway 40 having a profile for receiving a complementary key blade 114. The cylinder plug 24 has a first plurality of longitudinally-spaced radial chambers 42 that extend transversely to the longitudinal axis of the cylinder plug 24 from the outer surface of cylinder plug 24 and into the keyway 40. The first plurality of chambers 42 of the cylinder plug 24 are aligned with the chambers 36 of the cylinder lock body 22 when the cylinder plug 24 is in the cylinder lock body 22 and in a home position as depicted in FIGS. 2 and 3. The second locking mechanism is at least partially embodied in the cylinder plug 24 including a second plurality of longitudinally-spaced chambers 44 for receiving the second set of tumbler pins 28. The tumbler-receiving chambers 44 are circumferentially-spaced from the first plurality of chambers 42 and extend orthogonally into the keyway 40 from the outer surface of the cylinder plug 24 below a horizontal plane and to one side of a vertical plane passing through the central longitudinal axis of the cylinder plug 24. In this arrangement, the axes of the tumbler-receiving chambers 44 are oriented at right angles to the plane of the keyway 40. It is understood that the positions of the chambers 44 along the length of the keyway 40 may be varied to vary the locking code corresponding to the second locking mechanism. Although the cylinder lock 20 has been shown in one embodiment in which the axis of the chambers 44 is perpendicular to the plane of the keyway 40, the chambers may also be oriented at any other angle to the plane of the keyway 40 and the orientation of the locking bar 30 may also be changed correspondingly.

An inner end of the cylinder plug 24 defines a circumferential groove 46 for receiving a retaining ring 48 for retaining the cylinder plug 24 in the cylinder lock body 22. An actuator (not shown), such as a spindle or a torque blade, may be operatively connected for rotation with the cylinder plug 24 for performing a locking or unlocking function, as is known in the art.

The first set of tumbler pins 26 comprises a plurality of conventional split pins, each including axially superimposed upper portions 50 and lower portions 52 having facing end surfaces. The first set of tumbler pins 26 are slidably disposed within the chambers 36 in the cylinder lock body 22 and the first plurality of chambers 42 of the cylinder plug 24. The lengths of the upper and lower portions 50, 52 of the pins 26 vary for defining a first locking code. The first set of tumbler pins 26 are biased by dedicated helical springs 54 compressed between the upper end surfaces of the pins and a retaining plate 56. The retaining plate 56 is press fit, staked or otherwise secured in the groove 38 in the cylinder lock body 22 such that the retaining plate 56 is flush with the outer surface of the lock cylinder body 22 (FIGS. 2 and 3). The springs 54 function to bias the first set of tumbler pins 26 towards the keyway 40 such that the upper portions 50 of the pins 26 extend across the shear surface when the cylinder lock 20 is in a locked condition.

Referring to FIGS. 4A-4D, the second set of tumbler pins 28 may comprise, in one embodiment, a tumbler pin generally designated at 58 and including a generally cylindrical body portion 60 terminating at an inner end having a chisel-shaped tip 62. The tip 62 includes opposed oblique planar side surfaces 63 angling inwardly from the body portion 60. The side surfaces 63 of the tip 62 merge into a rounded ridge at an inner end surface 65. The body portion 60 of the tumbler pin 28 has a longitudinal slot 64 formed in the peripheral surface. The outer end surface 66 of the tumbler pin 28 extends obliquely to the longitudinal axis of the tumbler pin. A portion of the edge 68 of the outer end surface 66 is chamfered such that the surface 68 is substantially perpendicular to the longitudinal axis of the tumbler pin 58. The material removed for forming the chamfered end surface 68 allows clearance of the outer end of the tumbler pin 58 for rotation of the cylinder plug 24 relative to the cylinder lock body 22. The cylindrical outer surface of the body portion 60 of the tumbler pin 58 adjoins the tip 62 forming a shallow rim 70 which tapers inwardly with the opposed oblique planar side surface 63 of the tip 62 angling inwardly from the rim 70. A plane passing through the rim 70 is substantially perpendicular to the longitudinal axis of the tumbler pin 58. As shown in FIG. 2, the rim 70 functions as a stop which limits the inward movement of the tumbler pin 58 such that only the chisel-shaped tip 62 projects into the keyway 40.

In another embodiment shown in FIGS. 5A-5D, the second set of tumbler pins 28 may comprise a tumbler pin generally designated at 78 and including a generally cylindrical body portion 80 terminating at an inner end having a conical tip 82. The body portion 80 has a circumferential groove 84 formed in the peripheral surface. The outer end surface 86 of the tumbler pin 78 extends obliquely to the longitudinal axis of the tumbler pin. A portion 88 of the edge of the outer end surface 86 is chamfered such that a plane coincident with the chamfered surface 88 is substantially perpendicular to the longitudinal axis of the tumbler pin 58. The diameter of the body portion 80 of the tumbler pin 78 is larger than the diameter of the conical tip 82 where the body portion adjoins the tip, thereby forming a shallow rim 90. A plane passing through the rim 90 is substantially perpendicular to the longitudinal axis of the tumbler pin 58. The rim 90 functions as a stop which limits the inward movement of the tumbler pin 78 such that only the conical tip 82 projects into the keyway 40.

The second set of tumbler pins 28 are mounted in the chambers 44 in the side of the cylinder plug 24. Each of the second set of tumbler pins 28 has a longitudinal axis and is slidable axially within their respective chamber 44 relative to the cylinder plug 24. Each of the second set of tumbler pins 28 is also able to rotate about their respective longitudinal axes relative to the cylinder plug 24.

Figures 6A, 6B, 6C:
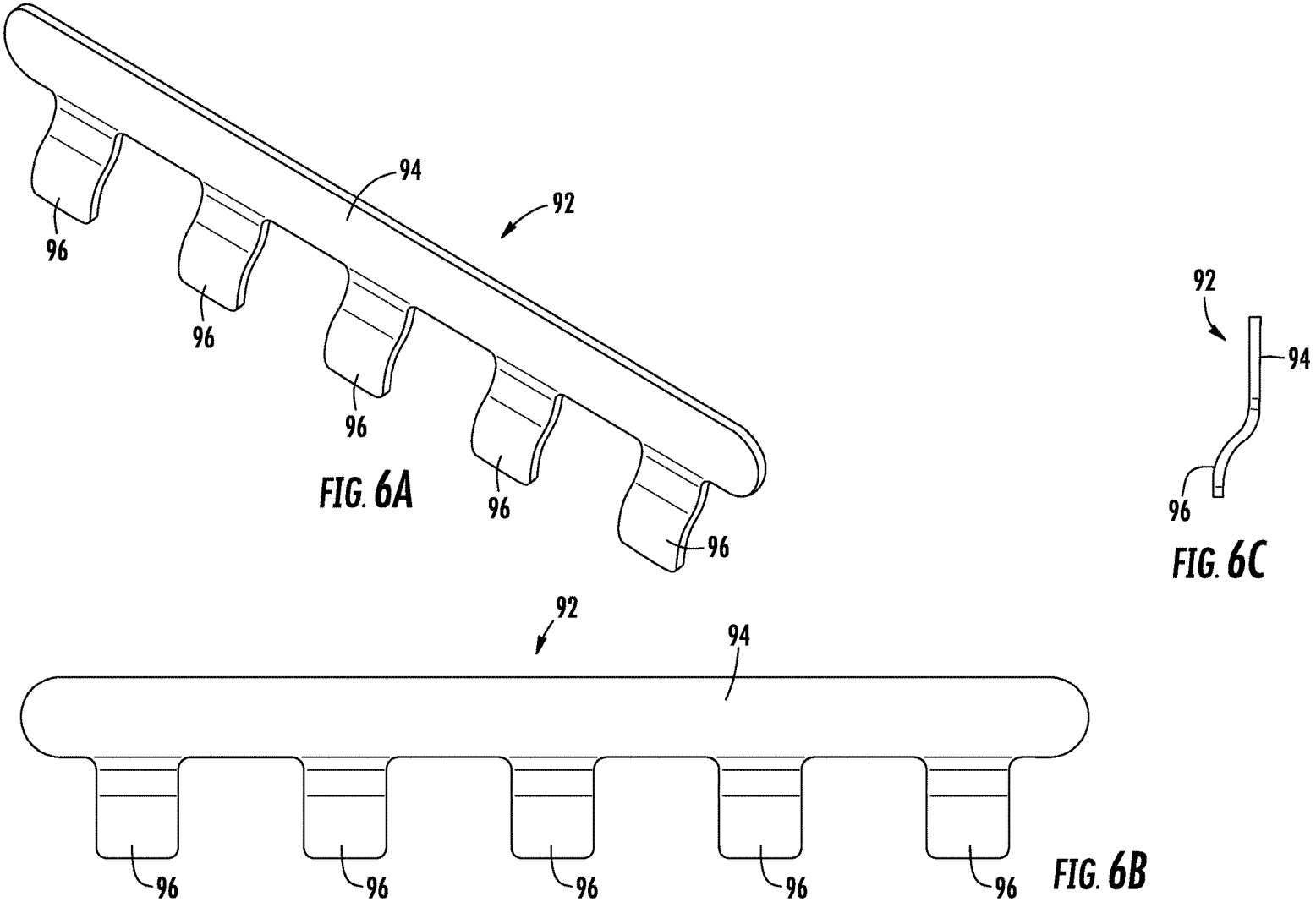
FIGS. 6A-6C are a perspective view, a side elevation and an end elevation view, respectively, of an embodiment of a tumbler pin spring for use in a cylinder lock assembly as shown in FIG. 1.

A leaf spring 92 (FIG. 1) is provided for biasing the second set of tumbler pins 28 towards the keyway 40. Referring to FIG. 6, the leaf spring 92 comprises an elongated body member 94, a plurality of longitudinally spaced, slightly curved fingers 96 projecting transversely from the body member 94. The leaf spring 92 is disposed in a longitudinal slot 49 (FIG. 1) in the outer surface of the cylinder plug 24. The slot 49 is contiguous with the chambers 44 in the side of the cylinder plug 24 such that each finger 96 engages an outer end surface 66, 86 of a tumbler pin 58, 78.

In the embodiment shown in the FIGs., there are six chambers 36, 42 common to the cylinder lock body 22 and the cylinder plug 24 for the first set of tumbler pins 26 and five side chambers 44 in the cylinder plug 24 for the second set of tumbler pins 28. More or fewer chambers are possible and may be used if desired, as may any of many different variations of conventional designs for the first set of tumbler pins 28. Such variations include splitting the first set of tumbler pins 28 into more than two portions to accommodate master keying, varying the shapes and dimensions of the tumbler pins 28 to make it more difficult to pick the lock, and the like.

Figure 7A:
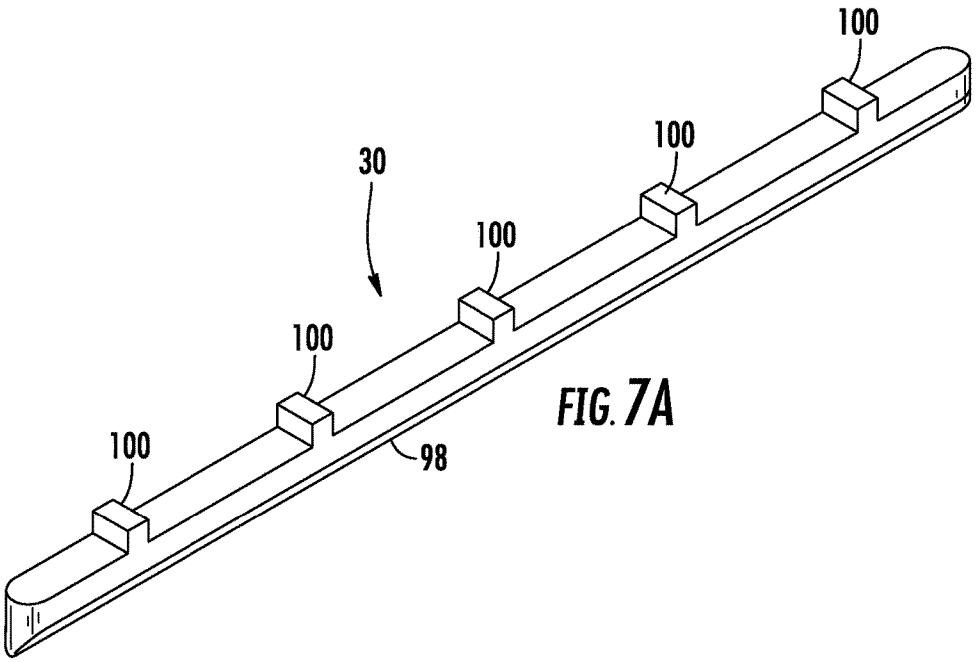
FIGS. 7A-7C are a perspective view, a side elevation view and an end elevation view, respectively, of a locking bar for use in a cylinder lock assembly as shown in FIG. 1.
Figure 7B:
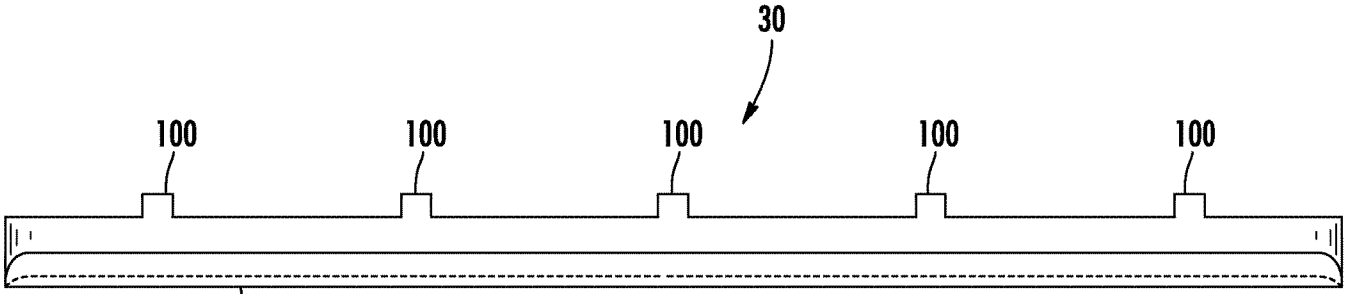
Figure 7C:
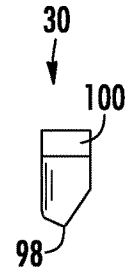

Referring to FIG. 7, the locking bar 30 is an elongated member extending substantially the length of the cylinder plug 24. It is understood that the locking bar 30 can be formed in various lengths to provide for numerous different secondary locking options with a single keyway design. The locking bar 30 includes a triangular edge 98 on one side. Opposite the triangular edge 98, the locking bar 30 includes a plurality of longitudinally spaced lugs 100 extending transversely from the locking bar 30. The lugs 100 are configured to engage in the slots 64 or grooves 84 formed in the first embodiment or second embodiment 58, 78, respectively, of the second set of tumbler pins 28. A lug 100 is provided for each tumbler pin 28 position.

As shown in FIG. 3, the locking bar 30 is reciprocally mounted in a longitudinal slot 102 in the outer surface of the cylinder plug 24. The longitudinal slot 102 opens into the second plurality of chambers 44 in the cylinder plug 24. In the embodiment shown, the slot 102 runs substantially the entire length of the keyway 40. The locking bar 30 is biased outwardly by a pair of springs 104 disposed at each end of the locking bar 30 in spring bores 106 in the cylinder plug 24. A longitudinal V-shaped groove 108 is defined in the cylindrical inner surface of the cylinder lock body 22 and configured to receive the locking bar 30. The springs 104 bias the locking bar 30 towards a position where the locking bar 30 is seated in the groove 108 (FIG. 2). In this position, the locking bar 30 spans the shear plane effectively preventing the cylinder plug 24 from rotating in the cylinder shell 32.

The second locking mechanism, including the second set of tumbler pins 28 and the locking bar 30, is located in the lower right quadrant of the cylinder plug as seen in FIG. 2.

Figure 8:
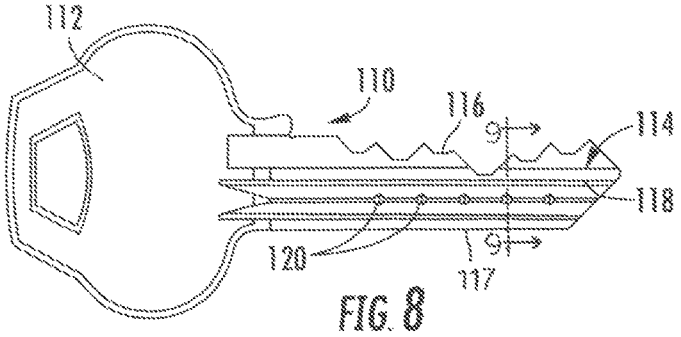
FIG. 8 is a side elevation view of the key as shown in FIG. 1.
Figure 9:
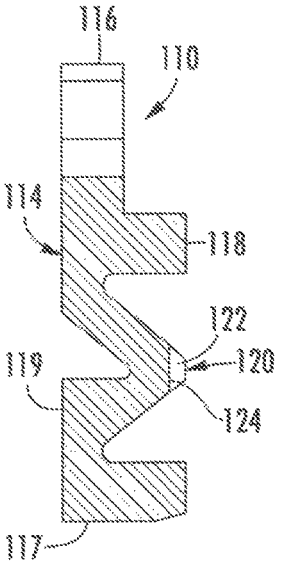
FIG. 9 is a transverse cross-section view of the key blade taken along line 9-9 of FIG. 8.
Figure 10:
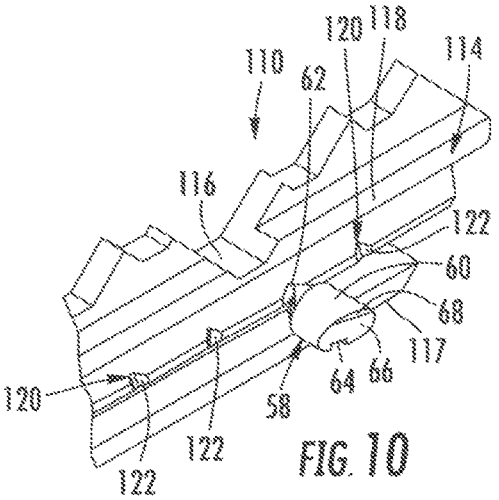
FIG. 10 is a close-up perspective view of the key blade as shown in FIG. 8 showing an adjacent side chisel tip tumbler pin.
Figure 11:
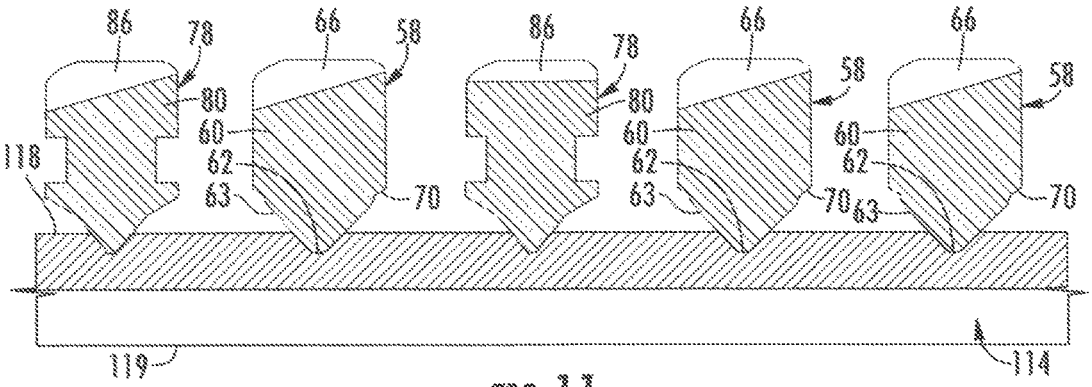
FIG. 11 is a longitudinal cross-section of the key blade as shown in FIG. 8 showing side tumbler pins in the notches in the key blade.

Referring to FIGS. 8-10, the cylinder lock assembly 20 includes a key 110 for operation of the cylinder lock assembly 20. The key 110 comprises a key bow 112 and a key blade 114 having a longitudinal axis. The key blade 114 has a longitudinal upper edge 116, an opposite lower edge 117, and a pair of oppositely directed and transversely extending side faces 118, 119. The upper edge 116 is formed with standard bit cutouts. A plurality of notches 120 of varying angle and depth are formed in one side face 118 of the key 110. The notches 120 are longitudinally spaced the same relative distances as each side tumbler chamber 44 and are configured to accommodate and rotate the second set of tumbler pins 28. The shape and size of each notch 120 in the side face 118 of the key blade 114 is defined by opposed inwardly angled side walls 122 adjoining smoothly with a substantially rectangular, flat bottom surface 124. The angled side walls 122 of the notches 120 act as a ramp or camming surface for contacting and rotating the second set of tumbler pins 28. As shown in FIGS. 10 and 11, the notches 120 are configured such that the tips 62, 82 of the tumbler pins 58, 78 extend into and contact both side walls 122 of the notches 120. With respect to the first embodiment 58 of the second set of tumbler pins 28, the action of the side surfaces 63 of the tip 62 against the side walls 122 of the notches 120 functions to rotate the tumbler pins 58 to align with the notches 120. It is understood that the angle and depth of the notches 120 control the second set of tumbler pins 28 and thus determine the locking code pattern for the second locking mechanism. Moreover, while the proper key allows operation of the cylindrical lock, it is understood by those skilled in the art that numerous other variations of the key can be formed without departing from the scope of the present invention.

FIGS. 2 and 3 show the position of the first and second locking mechanisms when the cylinder lock 20 is in a locked condition prior to insertion of a proper key, with the cylinder plug 24 in the home position relative to the cylinder lock body 22. In this position, the upper portions 50 of the first set of tumbler pins 26 extend across the shear plane between the cylinder plug 24 and the cylinder lock body 22. Also in the locked condition, the locking bar 30 extends across the shear plane into the groove 108 formed in the interior surface of the cylinder lock body 22. The second set of tumbler pins 28 engage the locking bar 30 to prevent the locking bar 30 from moving out of the groove 108. More particularly, the second set of tumbler pins 28 are misaligned with the locking bar 30, preventing the lugs 100 of the locking bar 30 from moving into the slots 64 or grooves 84 in the second set of tumbler pins 58, 78, respectively, and securing the locking bar 30 in the groove 108. By extending across the shear plane, the first set of tumbler pins 26 and the locking bar 30 prevent the cylinder plug 24 from rotating whenever a key is not inserted in the keyway 40 or whenever a key having the incorrect code is inserted.

Only when a key 110 comprising the proper first code and second code, with bits and notches of the correct predetermined depth and angle, is inserted in the keyway 40 can the first set of tumbler pins 26 and the second set of tumbler pins 28 be properly positioned permitting the cylinder plug 24 to be rotated.

Figure 12:
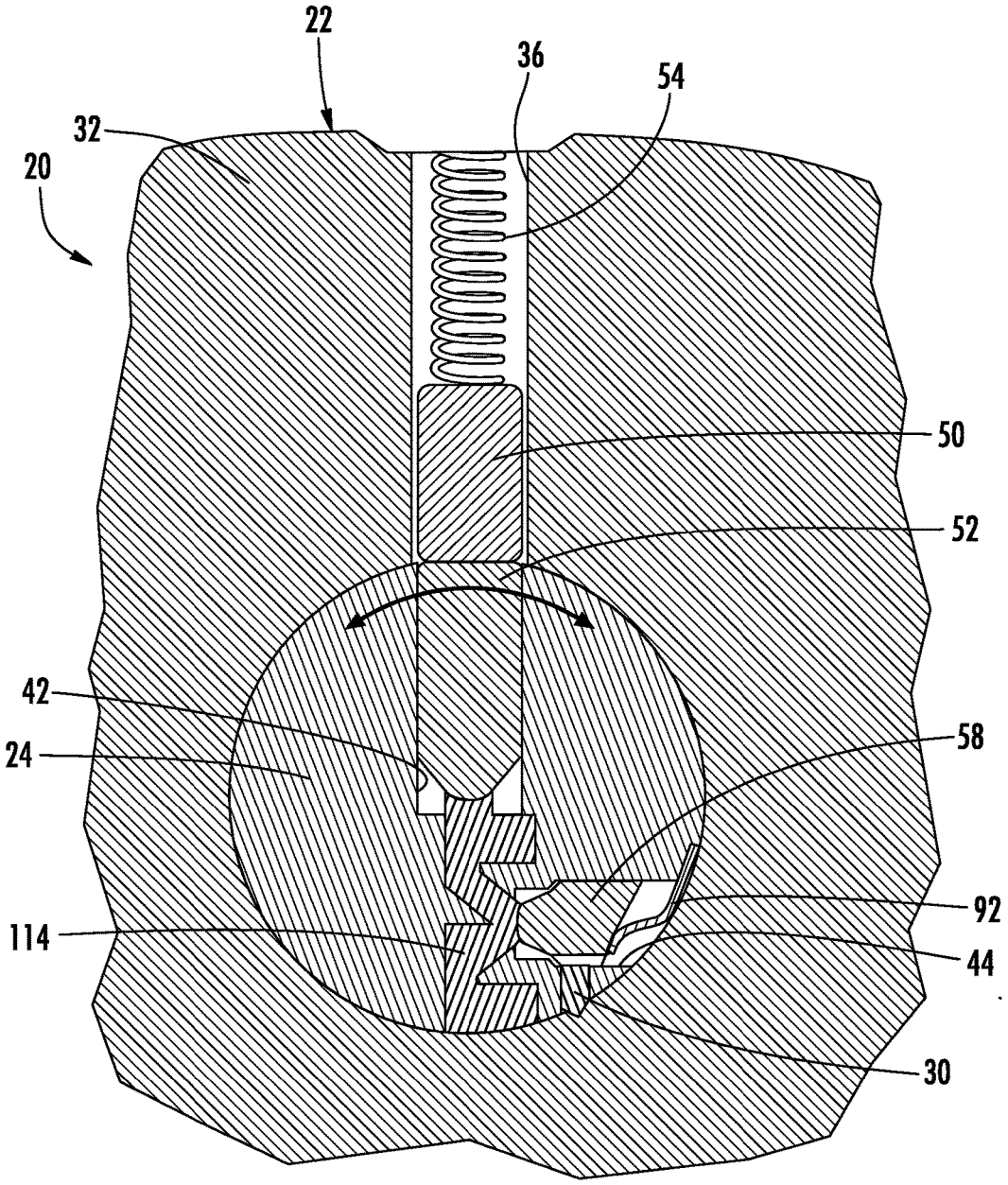
FIG. 12 is a transverse cross-section view of the cylinder lock as shown in FIG. 2 with a key in the keyway and in an unlocked condition.
Figure 13:
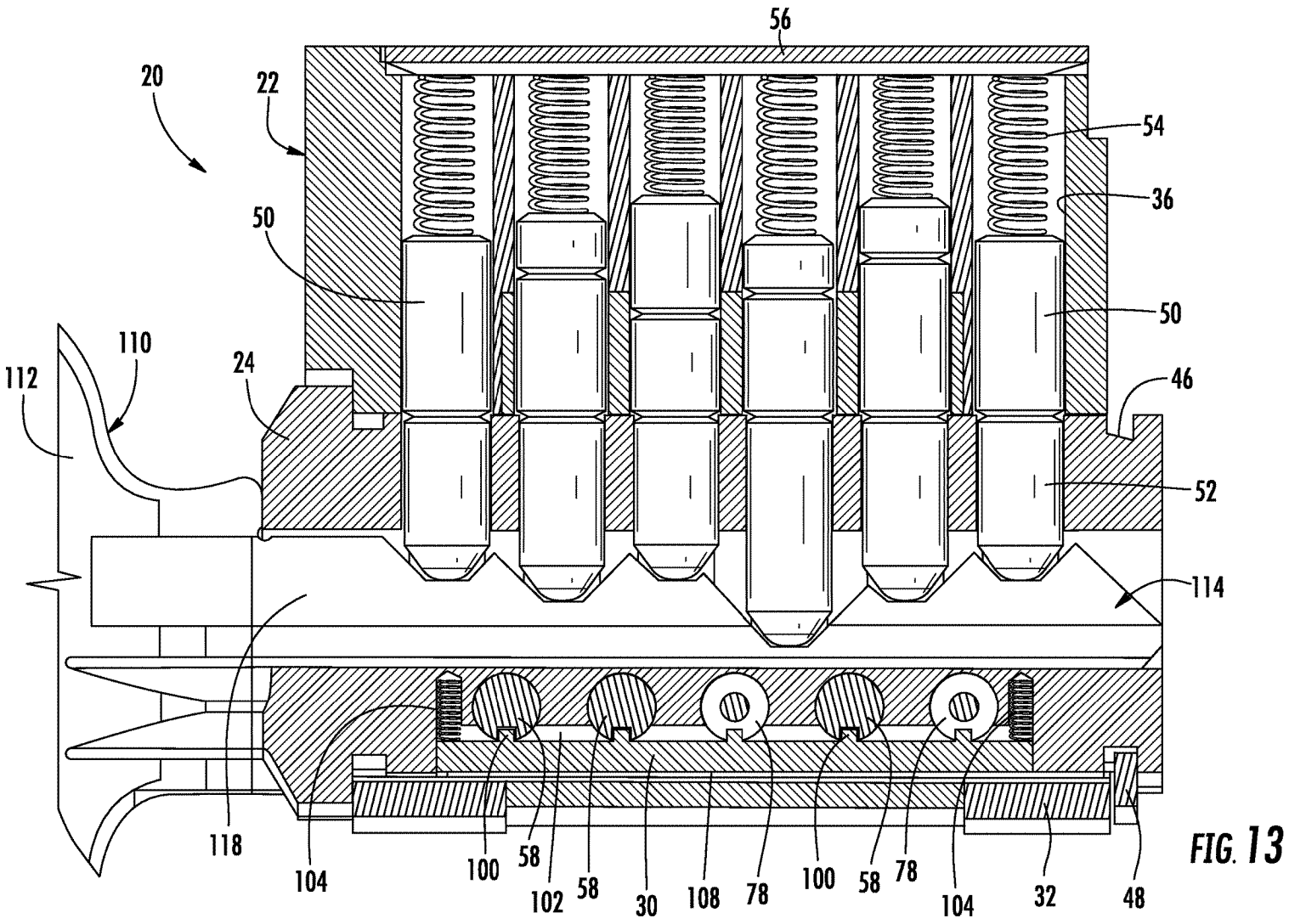
FIG. 13 is a longitudinal cross-section view of the portion of the cylinder lock assembly as shown in FIG. 12 with a key in the keyway and in an unlocked condition.
Figure 14:
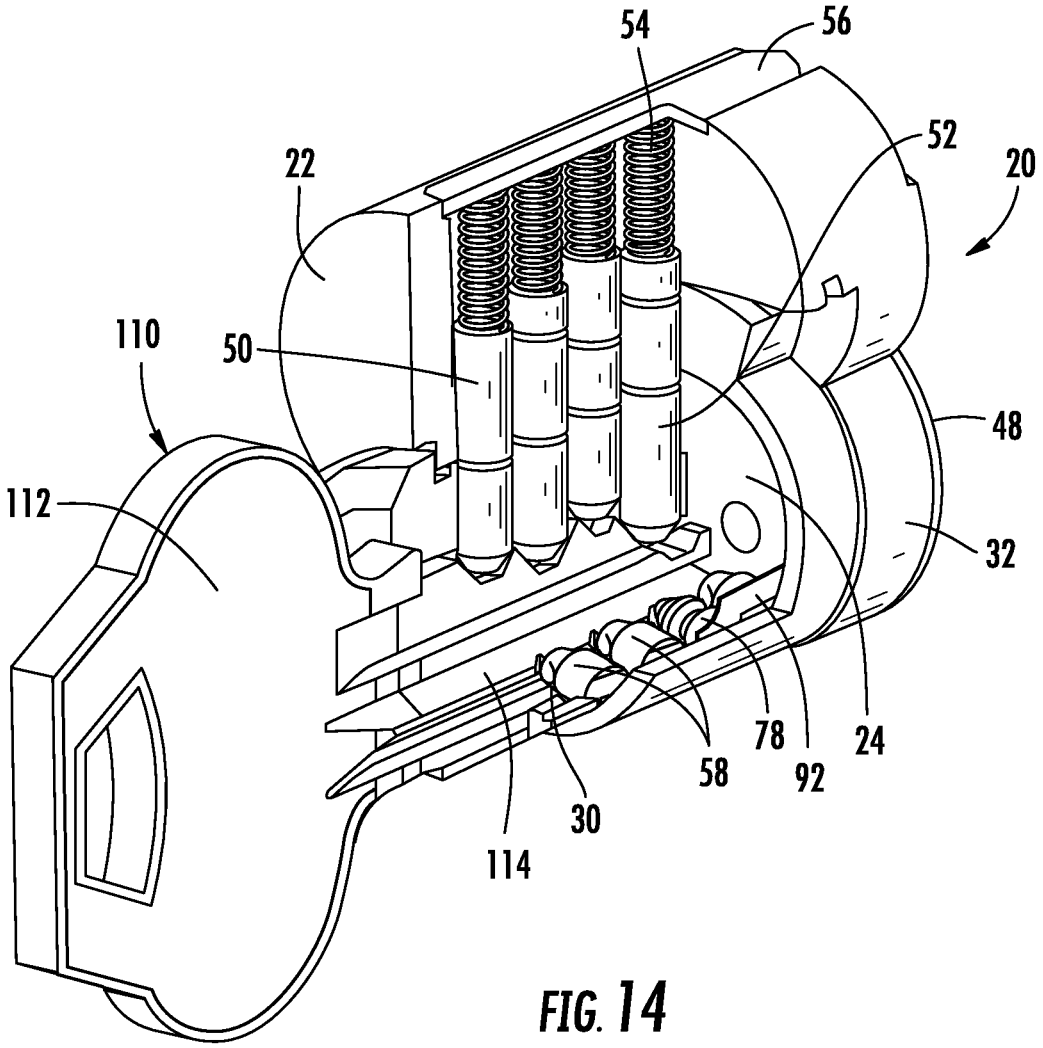
FIG. 14 is a perspective view in partial cross-section of the cylinder lock assembly as shown in FIG. 1 with a key in the keyway showing both sets of tumbler pins and in an unlocked condition.

FIGS. 12-14 show the unlocked condition of the cylinder lock 20 when the properly configured key 110 is inserted into the keyway 40 and the cylinder plug 24 is in the home position. The ends of the lower portions 52 of the first set of tumbler pins 26 cooperate with the key profile formed along the upper edge 116 of the key blade 114. When a key blade 114 having the correct heights encoded into the bits in the upper edge 116 of the key blade 114 is inserted into the keyway 40, the first set of tumbler pins 26 are positioned in the chambers 36 so that the junction between the upper and lower portions 50, 52 of the tumbler pins 26 are aligned with the shear surface to allow rotation of the cylinder plug 24 relative to the cylinder lock body 22.

Figure 15:
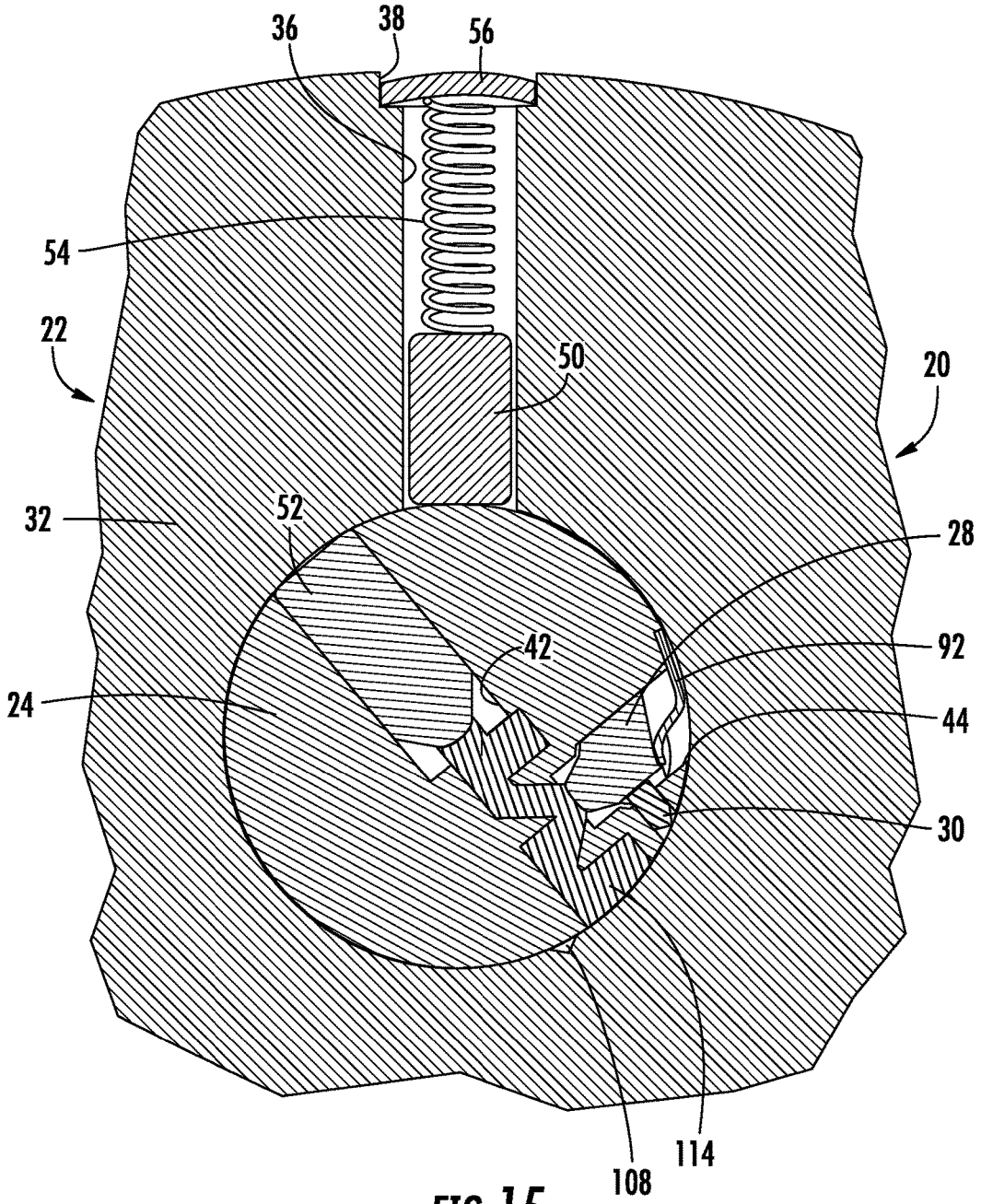
FIG. 15 is a transverse cross-section view of the cylinder lock as shown in FIG. 12 with a key in the keyway and the cylinder plug partially rotated relative to the shell.

The proper key 110 also causes axial re-positioning of the second set of tumbler pins 28 and rotation of the second embodiment 58 of the set of tumbler pins 28 about their axes by virtue of the chisel-shaped tips 62 biased against the side walls 122 of the notches 120 in the key blade 114. More particularly, the tips 62, 82 of the first embodiment 58 and the second embodiment 78 of the second set of tumbler pins 28 bear against the spaced notches 120 in the side face 118 of the key 110 under the biasing action of the spring 92. The chisel-shaped tip 62 of the tumbler pins 28 will engage with the angled walls 122 defining the notches 102 so as to cause an axial as well as a rotational movement of the tumbler pins 28. The end surface 65 of the tip 62 and the walls 122 of the notches 120 work against one another to rotate the tumbler pins 58. In this manner, the tumbler pins 58 are able to rotate into the notches 120 until the ends of the tips 62 contact both walls 122 of the notches 120. The spring 92 further serves to bias the conical tips 82 of the second embodiment 78 of the second set of tumbler pins 28 into corresponding notches 120 of predetermined depth. In this position, the axial slots 64 and grooves 84 in the body portions 60, 80 of the tumbler pins 58, 78, respectively, will be aligned with the lugs 100 on the locking bar 30 as best shown in FIG. 13. The lugs 100 thus have sufficient space for radially inward movement upon turning of the cylinder plug 24 with the key 110. Accordingly, the locking bar 30 is free to cam out of the seated position in the groove 108 in the cylinder lock body 22 as a result of rotation imparted to the cylinder plug 24 by the key 110 as shown in FIG. 15. The cam-like triangular edge 98 of the locking bar 30 rides up the angled sides of the V-shaped groove 108, compressing the springs 104 at the ends of the locking bar 30. The locking bar 30 advances radially inwardly into the slot 102 in the cylinder plug 24 and clear of the shear surface. The lugs 100 are accommodated by the slots 64 and grooves 84 in the tumblers as shown in FIG. 14. Now, the cylinder plug 24 can be freely rotated within the cylinder lock body 22. Only when key with the properly angled sidewalls 122 and depth for each notch 120 in the proper location is provided will the second set of tumbler pins 28 be positioned to the proper relative axial location and rotational position to allow the locking bar 30 to slide into its unlocked position.

As described herein, a cylinder lock 20 is provided with tumbler pins 28 and a locking bar 30 as a second locking mechanism that operates independently of a first locking mechanism comprising conventional tumbler pins 26. Operation of the cylinder lock 20 is prevented unless a key 110 properly configured for both the first and second locking mechanisms is inserted in the keyway 40. Accordingly, the cylinder lock 20 with the additional locking mechanism provides a high degree of security. A key blank that is merely copied to fit conventional tumbler pins will not open the cylinder lock 20; therefore, the cylinder lock 20 cannot be easily circumvented by unauthorized key duplication. The cylinder lock 20 also offers a high number of different opening combinations, corresponding to an identical number of different keys. The possible lock codes associated with the second locking mechanism involve different combinations of predetermined axial positions and rotational positions of the second set of tumbler pins 28.

Moreover, the cylinder lock 20 described herein is compact, even with a second locking mechanism, and sufficient space remains in the cylinder body 22 for additional locking mechanisms of the same or different designs. For example, the second locking mechanism itself is sufficiently compact that it may be duplicated on the other side of the cylinder plug 24 to provide a tertiary locking code. In this embodiment, the key blade 114 may have code patterns in the form of notches 120 on both side faces 118, 119 for cooperating with tumbler pins arranged on both sides of the keyway 40. Of course, the side code pattern, or patterns, may be combined with any other code patterns anywhere on the key blade 114. In some extremely high security applications it may be desirable to have two or more sets of conventional tumbler pins arranged in the upper quadrants of the cylinder plug 24. It is also possible to provide symmetrical keys which can be introduced in the lock with either side up, and where the code pattern of either side face 118, 119 of the key blade 114 has its "mirror" code pattern on the other side face.

The user also has the option of adapting the cylinder lock to a new key any time that security suggests. The code patterns may be changed several times without the need to remove or replace any of the tumbler pins 28 used in the second locking mechanism.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. Accordingly, we intend to cover all such modifications, omission, additions and equivalents as may be included within the spirit and scope of the invention as defined by the following claims. In the claims, means-plus-function clauses are intended to cover the structures described herein as performing the recited function, and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A lock assembly comprising:

a lock body comprising a bore defining an inner surface and a longitudinal axis and a longitudinal groove extending along at least a portion of the inner surface;

a cylinder plug rotatably disposed in the bore of the lock body and defining a keyway and a plurality of longitudinally spaced chambers extending from an outer surface of the cylinder plug and opening into the keyway, and a longitudinal slot in the outer surface of the cylinder plug and opening into the plurality of longitudinally spaced chambers;

a first pin disposed in at least one of the plurality of longitudinally spaced chambers for rotational movement about its axis relative to the cylinder plug between a first orientation and a second orientation, the first pin comprising a first body defining a longitudinal slot, and a second pin disposed in at least another one of the plurality of longitudinally spaced chambers for reciprocal movement along its axis relative to the cylinder plug between a first orientation and a second orientation, the second pin comprising a second body defining a circumferential groove;

an elongated spring member comprising fingers engaging the first pin and the second pin, the elongated spring member further comprising a body member supporting the fingers, the body member being held between the cylinder plug and the lock body such that the fingers are maintained in engagement with the first pin and the second pin to retain the first pin and the second pin in the plurality of chambers and to bias the first pin and the second pin towards the keyway;

a locking bar disposed in the longitudinal slot in the cylinder plug for movement between a first position where the locking bar is received in the longitudinal groove and a second position where the locking bar is removed from the longitudinal groove, the locking bar comprising a first lug engageable with the first body of the first pin when the first pin is in the first orientation and a second lug engageable with the second body of the second pin when the second pin is in the first orientation to prevent the locking bar from moving from the first position to the second position, and the first lug engageable with the longitudinal slot of the first pin when the first pin is in the second orientation and the second lug engageable with the circumferential groove of the second pin when the second pin is in the second orientation to allow the locking bar to move from the first position to the second position;

a spring for biasing the locking bar to the first position;

wherein upon insertion of a proper key in the keyway the first pin is rotated about its axis between the first orientation and the second orientation and the second pin is reciprocated along its axis between the first orientation and the second orientation such that rotation of the key rotates the cylinder plug relative to the lock body and the locking bar cams against the longitudinal groove in the lock body to move the locking bar from the first position to the second position.

2. The lock assembly of claim 1, wherein the body member of the elongated spring member is positioned in a slot formed in an outer surface of the cylinder plug.

3. The lock assembly of claim 1, wherein the first body tapers inwardly toward the inner end to form a chisel tip.

4. The lock assembly of claim 1, wherein the second body tapers inwardly toward the inner end to form a conical tip.

5. The lock assembly of claim 1, wherein one of the fingers extends into one of the plurality of longitudinally spaced chambers for engaging an outer end surface of the first pin and the second pin.

6. A lock assembly comprising:

a lock body comprising a bore defining an inner surface and a longitudinal axis and a longitudinal groove extending along at least a portion of the inner surface;

a cylinder plug rotatably disposed in the bore of the lock body and defining a keyway for receiving a key, the key comprising an edge and a face disposed transverse to the edge, the cylinder plug comprising a plurality of radial chambers, the plurality of radial chambers receiving a first plurality of tumbler pins, the plurality of radial chambers intersecting the keyway in a first direction such that the first plurality of tumbler pins reciprocate along the first direction to engage the edge of the key;

the cylinder plug further comprising a plurality of longitudinally spaced chambers extending from an outer surface of the cylinder plug and opening into the keyway, the plurality of longitudinally spaced chambers intersecting the keyway in a second direction at a non-parallel angle relative to the first direction, the longitudinally spaced chambers receiving a second plurality of tumbler pins, such that the second plurality of tumbler pins reciprocate along the second direction to engage the face of the key, each of the second plurality of tumbler pins comprising a recess, the second plurality of tumbler pins comprising a first type of tumbler pin and a second type of tumbler pin where reciprocation of the first type of tumbler pin moves the associated recess between a first orientation and a second orientation and reciprocation of the second type of tumbler pin rotates the second type of tumbler pin to move the associated recess between a first orientation and a second orientation;

the cylinder plug further comprising a longitudinal slot defined in the outer surface of the cylinder plug and opening into the plurality of longitudinally spaced chambers;

an elongated spring member engaging the second plurality of tumbler pins, the elongated spring member held between the cylinder plug and the lock body such that the spring member engages the second plurality of tumbler pins to retain the second plurality of tumbler pins in the plurality of chambers and to bias the second plurality of tumbler pins towards the keyway;

a locking bar disposed in the longitudinal slot in the cylinder plug for movement between a first position where the locking bar is received in the longitudinal groove and a second position where the locking bar is removed from the longitudinal groove, the locking bar comprising a plurality of lugs engageable with the second plurality of tumbler pins when the second plurality of tumbler pins are in the first orientation to prevent the locking bar from moving from the first position to the second position and the plurality of lugs engageable with the recess on the second plurality of tumbler pins when the second plurality of tumbler pins are in the second orientation to allow the locking bar to move from the first position to the second position;

a spring for biasing the locking bar to the first position;

wherein upon insertion of a proper key in the keyway the first plurality of tumbler pins are moved to an unlocked position and the second plurality of tumbler pins are moved between the first orientation and the second orientation such that rotation of the key rotates the cylinder plug relative to the lock body and the locking bar cams against the longitudinal groove in the lock body to move the locking bar from the first position to the second position.

7. The lock assembly of claim 6, wherein the spring member comprises a plurality of fingers, each of the fingers engaging one of the second plurality of tumbler pins, wherein the fingers act against an outer end surface of the second plurality of tumbler pins for urging the second plurality of tumbler pins toward the keyway.

8. The lock assembly of claim 6, wherein each of the second plurality of tumbler pins comprises a body portion having an outer end and an inner end, and wherein the recess of at least one pin of the second plurality of tumbler pins comprise a longitudinal groove defined by the body portion extending at least partially between the outer and inner ends.

9. The lock assembly of claim 8, wherein the body portion of the at least one pin of the second plurality of tumbler pins tapers inwardly toward the inner end from opposite sides of a point intermediate the outer and inner ends of the body portion to form a chisel tip.

10. The lock assembly of claim 9, wherein the at least one pin of the second plurality of tumbler pins rotates between the first orientation and the second orientation.

11. The lock assembly of claim 6, wherein each of the second plurality of tumbler pins comprises a body portion having an outer end and an inner end, and wherein the recess of at least one second pin of the second plurality of tumbler pins is a circumferential groove defined by the body portion intermediate the outer and inner ends.

12. The lock assembly of claim 11, wherein the body portion of the at least one second pin of the second plurality of tumbler pins tapers inwardly toward the inner end to form a conical tip.

13. The lock assembly of claim 12, wherein the at least one second pin of the second plurality of tumbler pins reciprocates between the first orientation and the second orientation.

14. The lock assembly of claim 6, wherein first ones of the second plurality of tumbler pins rotate between a first orientation and the second orientation and second ones of the second plurality of tumbler pins reciprocate between the first orientation and the second orientation.

15. The lock assembly of claim 14 wherein the first ones of the second plurality of tumbler pins comprise a longitudinal slot and the second ones of the second plurality of tumbler pins comprise a circumferential groove.

* * * * *